US008021500B2

(12) United States Patent
Tanaka et al.

(10) Patent No.: US 8,021,500 B2
(45) Date of Patent: Sep. 20, 2011

(54) ALUMINUM ALLOY FOR DIE CASTING AND MOLDED ARTICLE

(75) Inventors: Kenji Tanaka, Tokyo (JP); Takao Asami, Saitama (JP); Kiyoto Takeuchi, Kawasaki (JP); Yutaka Fujiwara, Fukushima (JP); Koukiti Takahashi, Fukushima (JP); Tadanori Manome, Fukushima (JP)

(73) Assignee: Tanaka Sangyo Co., Ltd., Tokyo (JP)

( * ) Notice: Subject to any disclaimer, the term of this patent is extended or adjusted under 35 U.S.C. 154(b) by 0 days.

(21) Appl. No.: 12/532,739

(22) PCT Filed: Mar. 23, 2007

(86) PCT No.: PCT/JP2007/055981

§ 371 (c)(1), (2), (4) Date: Oct. 29, 2009

(87) PCT Pub. No.: WO2008/117365

PCT Pub. Date: Oct. 2, 2008

(65) Prior Publication Data

US 2010/0054986 A1 Mar. 4, 2010

(51) Int. Cl.
*C22C 21/00* (2006.01)

(52) U.S. Cl. ..... 148/440; 420/545; 420/553

(58) Field of Classification Search ..... 148/440; 420/545, 553

See application file for complete search history.

(56) References Cited

FOREIGN PATENT DOCUMENTS

| | | | | |
|---|---|---|---|---|
| JP | 47-21344 | A | | 10/1972 |
| JP | 52-133012 | A | | 11/1977 |
| JP | 54-145316 | A | | 11/1979 |
| JP | 54145316 | A | * | 11/1979 |
| JP | 4-88142 | A | | 3/1992 |
| JP | 2007-119914 | A | | 5/2007 |

OTHER PUBLICATIONS

International Search Report of PCT/JP2007/055981, mailing date of Jun. 12, 2007.

* cited by examiner

*Primary Examiner* — Roy King
*Assistant Examiner* — Janelle Morillo
(74) *Attorney, Agent, or Firm* — Westerman, Hattori, Daniels & Adrian, LLP

(57) ABSTRACT

Provided are an aluminum alloy for die casting that has excellent die-castability, a molding with high hardness, and a molded article with excellent sheen. The aluminum alloy for die casting includes 0.5 to 2.5 wt. % Mn, 0.2 to 1.0 wt. % Cr, 0.1 to 0.5 wt. % Ti, 0.1 to less than 0.5 wt. % Mg, and Al. The molding is obtained by die-casting the aluminum alloy for die casting. The molding obtained by die-casting the aluminum alloy has excellent die-castability and high hardness. By performing the alumite treatment on the surface of the molding, a molded article having excellent sheen is obtained.

12 Claims, No Drawings

ALUMINUM ALLOY FOR DIE CASTING AND MOLDED ARTICLE

TECHNICAL FIELD

The present invention relates to an aluminum alloy for die casting, which is suitable for obtaining a molding with excellent die-castability and high hardness and also suitable for fabricating a molded article having high gloss without a gloss spot and exhibiting uniform color tone (having excellent sheen) by performing an alumite treatment (anodizing) on a surface of this molding, a molding obtained by die-casting the aluminum alloy, and a molded article obtained by performing an alumite treatment on the surface of the molding.

BACKGROUND ART

A molded article that is excellent in corrosion resistance and abrasion resistance, suitable for dyeing and coloring and has good appearance and decorativeness may be attained by performing an alumite treatment on a molding made from an aluminum alloy.

A die-casting process used to fabricate precision castings by injecting a molten metal into a mold is known as one of the methods of molding an aluminum alloy because the die-casting process is appropriate for mass production at a relatively low cost and can fabricate moldings with complicated shapes which are hardly achieved through a pressing process.

Desirably, an aluminum alloy used in a die-casting process may have such characteristics that there is no hot-tearing during die casting, and the aluminum alloy has excellent filling property and is not adhered to a mold (that is, has excellent die-castability).

In the related art, ADC6 (Al—Mg based alloy), ADC (Al—Si—Cu based alloy) or the like, which provides high productivity and has a hardness required for processing, has been developed as an aluminum alloy having excellent die-castability. However, these alloys are excellent in die-castability but it is difficult to obtain a molded article with excellent sheen through an alumite treatment of the obtained molding.

Patent Document 1 discloses a high-pressure casting aluminum alloy providing a uniform oxide film without a color spot. This alloy is advantageous in that it has excellent die-castability and a molded article with high hardness can be obtained, whereas the molded article does not have good sheen.

Therefore, it has been expected that a novel aluminum alloy for die casting which is applicable to the fabrication of a molded article having high hardness and excellent sheen will be developed.

Patent Document 1: Japanese Patent Application Laid-Open No. 52-133012

DISCLOSURE OF THE INVENTION

The present invention has been made in view of the above circumstances, and an object of the invention is to provide an aluminum alloy for die casting, which is suitable for obtaining a molding with excellent die-castability and high hardness and also suitable for fabricating a molded article having excellent sheen by performing an alumite treatment on a surface of this molding, a molding obtained by die-casting the aluminum alloy, and a molded article obtained by performing an alumite treatment on a surface of the molding.

The present inventors have ardently studied to solve the above-described problems, and as a result have found out that a molten aluminum alloy to which predetermined amounts of Mn, Cr, Ti and Mg are added is suitable for obtaining a molding with excellent die-castability and high hardness and fabricating a molded article with excellent sheen by performing an alumite treatment on the surface of this molding. Herein, the present inventors have completed the invention.

According to a first aspect of the invention, there is provided an aluminum alloy for die casting including 0.5 to 2.5 wt. % Mn, 0.2 to 1.0 wt. % Cr, 0.1 to 0.5 wt. % Ti, 0.1 to less than 0.5 wt. % Mg, and Al.

In the aluminum alloy of the invention, contents of both of Si and Fe are preferably less than 0.5 wt. %.

According to a second aspect of the invention, there is provided a molding obtained by die-casting the aluminum alloy for die casting according to the invention.

A surface hardness of the molding of the invention is preferably 35 HV or more.

According to a third aspect of the invention, there is provided a molded article obtained by performing an alumite treatment on the surface of the molding of the invention.

According to a fourth aspect of the invention, there is provided a molded article obtained by performing an alumite treatment on the surface of the molding that is attained by die-casting the aluminum alloy for die casting according to the invention.

The molded articles according to the third and fourth aspects of the invention may have a gloss level of 160 or more.

According to an aluminum alloy for die casting of the invention, a molding having excellent die-castability and high hardness can be attained. In addition, a molded article with excellent sheen can be fabricated by performing an alumite treatment on the surface of the molding.

According to an aluminum alloy for die casting of the invention, a molded article of which the surface is not wrinkled and has high gloss, good appearance and decorativeness can be fabricated with high efficiency.

A molded article of the invention is fabricated by die-casting an aluminum alloy of the invention, and thus the molded article provides high productivity and economic efficiency.

A molding of the invention has high hardness. Accordingly, a molded article (including the surface and inside thereof where the alumite treatment is not performed) obtained by performing an alumite treatment on the surface of the molding also has high hardness, and therefore this molded article has excellent processability, e.g., screw-machining.

Also, since the molded article of the invention has high gloss and excellent sheen, this molded article may be very suitably applicable to cases of household electrical appliances such as a camera and a mobile phone, which require high appearance quality and luxuriousness.

DETAILED DESCRIPTION OF THE INVENTION

The invention will be described in detail below.

1) Aluminum Alloy for Die Casting

An aluminum alloy for die casting of the invention (hereinafter, referred to as "aluminum alloy" for simplicity) includes 0.5 to 2.5 wt. % Mn, 0.2 to 1.0 wt. % Cr, 0.1 to 0.5 wt. % Ti, 0.1 to less than 0.5 wt. % Mg, and Al.

The aluminum alloy of the invention includes 0.5 to 2.5 wt. % Mn, preferably 0.5 to 2.0 wt. %.

Mn is an alloying element for solid-solution strengthening to thereby improve the hardness of a material. When the content of Mn is less than 0.5 wt. %, it is difficult to improve the hardness of a material. In contrast, when the content of Mn exceeds 2.5 wt. %, intermetallic compounds of primary crystals are created during die casting process. Hence, the content of Mn exceeding 2.5 wt. % is not desirable because the intermetallic compounds may deteriorate the sheen and cause a color spot to be produced.

The aluminum alloy of the invention includes 0.2 to 1.0 wt. % Cr.

Cr is an alloying element necessarily used to enhance the hardness of a molded article, and also used to enhance the gloss level of the molded article. The hardness of the molded article is low when the content of Cr is less than 0.2 wt. %. In contrast, when the content of Cr exceeds 1.0 wt. %, a liquidus temperature of the alloy rises to thereby deteriorate the solubility and castability of the alloy and also a color spot caused by the intermetallic compounds may be produced. Therefore, it is not desirable that the content of Cr exceeds 1.0 wt. %.

The aluminum alloy of the invention includes 0.1 to 0.5 wt. % Ti.

Ti is an alloying element for refining grains and allowing a color after the alumite treatment to be uniform, and is used to improve the hardness as well. When the content of Ti is less than 0.1 wt. %, theses effects are not sufficiently achieved. In contrast, when the content of Ti exceeds 0.5 wt. %, a liquidus temperature of the alloy rises to thereby deteriorate the solubility and castability of the alloy. Hence, it is not desirable that the content of Ti exceeds 0.5 wt. %.

The aluminum alloy of the invention includes 0.1 to 0.5 wt. % Mg, preferably 0.2 to 0.3 wt. %.

Mg is an alloying element used to improve the hardness of aluminum alloy, and also improve the gloss level. When the content of Mg is less than 0.1 wt. %, theses effects are not sufficiently achieved. In contrast, when the content of Mg exceeds 0.5 wt. %, a molten metal is susceptible to oxidation, an oxide film may be formed during die casting, and color spot may be produced after the alumite treatment. For this reason, it is not desirable that the content of Mg exceeds 0.5 wt. %.

In the aluminum alloy of the invention, contents of both of Si and Fe are preferably less than 0.5 wt. %, and more preferably, the total content of Si and Fe are preferably less than 0.5 wt. %. In the related art, it has been considered that Si and Fe are essential elements in an aluminum casting alloy because Si and Fe improve the strength of the alloy, the die-castability, and particularly, the adhesion property. However, according to the invention, by controlling the contents of both of Si and Fe to be less than 0.5 wt. %, preferably by controlling the total content of Si and Fe to be 0.5 wt. % or less, it is possible to fabricate a molded article that is not lowered in die-castability, is not wrinkled even after the alumite treatment, and has excellent sheen.

To control the total content of Si and Fe to be less than 0.5 wt. % in the aluminum alloy of the invention, a method of using Al, Mn, Cr, Ti and Mg containing small amount of Si and Fe is used as an example. Also, Si and/or Fe of which the content is less than 0.5 wt. % may be added to the molten aluminum alloy with Al, Mn, Cr, Ti and Mg added when the aluminum alloy is melted.

The aluminum alloy of the invention may contain impurities besides the above-described metal elements (Al, Mn, Cr, Ti, Mg, Si and Fe). Although it is desirable that the amount of the impurities should be smaller, it is permissible as long as the amount of impurities does not have an effect on properties of the aluminum alloy of the invention.

The aluminum alloy of the invention may be fabricated by melting Al, Mn, Cr, Ti and Mg according to the composition described above. A melting process is not particularly limited, and thus a publicly-known melting process may be employed, for example, a fusion process.

The aluminum alloy of the invention has characteristics that there is no hot-tearing during die casting, the aluminum alloy has excellent filling property, is not adhered to a mold, and has excellent die-castability. Here, in the case where the aluminum alloy is adhered to a mold, a molten metal adhered to the surface of the mold expands so that defects such as an underfill or a rough surface may be created during die-casting at a region where the molten metal is adhered to the surface of the mold. The excellent hot-tearing resistance, filling property and adhesion resistance may be confirmed by observing a die-cast molding with eyes.

The aluminum alloy of the invention is useful as a raw material for an aluminum molded article having high hardness and excellent sheen compared to the conventional aluminum alloy.

2) Molding and Molded Article

A molding of the invention is obtained by die-casting the aluminum alloy of the invention. A molded article of the invention is obtained by performing an alumite treatment on the surface of the molding of the invention.

In more detail, the molded article of the invention may be attained by die-casting the aluminum alloy of the invention to obtain a molding having a desired shape (step 1), performing an alumite treatment on the molding (step 2), and performing a sealing process on the resultant (step 3). Hereinafter, this process sequence will be described in detail.

(Step 1)

In step 1, a molding with a desired shape is attained by die-casting the aluminum alloy of the invention.

A die-casting refers to a method of fabricating a molding by injecting a molten metal into a mold.

The die-casting method used in the invention is not specifically limited, but a pressure die-casting method of injecting a molten metal into a die cavity under high pressure may be desirably used.

The die-casting method has high degree of freedom in processing and excellent dimensional accuracy, and therefore it is effectively applied to the fabrication of a molding having an acute angle corner and a small thickness. Furthermore, the die-casting method is very economical, and particularly an automated electric-controlled hydraulic pressure die-casting is useful for mass production.

An apparatus for use in the die-casting may be a hot chamber type or a cold chamber type, and the cold chamber type is more preferable.

A temperature of the die-casting may range from 500 to 1,000° C. normally, preferably between 600 to 850° C.

A mold for use in the die-casting is not specifically limited, and thus a mold made of a well-known material may be used. In addition, a shape of the mold is not particularly limited, that is, the mold with a complicated shape may also be used because the aluminum alloy of the invention has excellent die-castability.

The molding of the invention prepared by the above-described procedure has high hardness. Therefore, a molded article (even a portion not undergoing the alumite treatment) obtained by performing an alumite treatment on the surface of the molding also has high hardness, and therefore a fitting-processing such as a screw-machining is possible.

It is preferable that the surface of the molding of the invention is 35 HV or more, more preferably 40 HV or more, in terms of Vickers hardness (HV) according to the Vickers Hardness Testing method based on JIS Z2244. The hardness of the molding may be measured using a publicly-known hardness tester.

(Step 2)

Next, an alumite treatment is performed on the molding obtained in Step 1.

The alumite treatment is a process of forming a porous hard oxide film on the surface of the molding by dipping the molding into an aqueous solution such as of oxalic acid, boric acid, sulfuric acid and chromic acid, and by applying a constant electric current thereto. The alumite treatment is performed for the purpose of protecting the surface of the aluminum molding.

In the invention, current density, processing temperature, processing time, and the like are not specifically limited in the alumite treatment, and thus may be appropriately designed according to a size, shape and use of the target molded article. The current density at the time of the alumite treatment ranges from 0.1 to 0.2 A/dm$^2$ in general, the processing temperature ranges from 10 to 70° C. in general, and the processing time for the alumite treatment ranges from several minutes/area to several hours/area in general.

The alumite treatment efficiency may be improved by buffing the surface of the molding or performing a chemical polishing treatment using a phosphoric acid-based treatment solution prior to the alumite treatment.

After the alumite treatment, a thin oxide film is formed on the surface of the molding. This oxide film has a bilayered structure including a porous hard layer having a thickness of several μm in which pinholes (micro-holes) having a diameter ranging from several tens of nanometers to several hundred nanometers are formed vertically, and a densified layer with small thickness provided between the bottom of the pinhole and an alloy interface. This oxide film has high transparency, does not loose a metallic color even after it is dyed, and has excellent decorativeness.

(Step 3)

A sealing process is performed after the alumite treatment. The surface of the oxide film after the alumite treatment may be easily contaminated and further unstable because the surface of the oxide film is porous and adsorbent. For this reason, it is necessary to perform the sealing processing for eliminating the adsorbability by filling up the plurality of micro-holes of the oxide film.

The sealing process is not specifically limited, and may be selected depending on a shape or use of the molding subject to the sealing process after the alumite treatment. Examples of the sealing process include (i) a metal salt sealing process using a metal salt such as acetic acid nickel, acetic acid cobalt and boric acid (salt), (ii) a vapor sealing process using a high pressure steam of 100° C. or more, and (iii) a low-temperature sealing process using a fluoride.

The molded article of the invention has high gloss level. The gloss level is an index indicating how much amount of light reaching the surface of an object is specularly reflected. According to JIS Z8741, a reflectance of 10% is defined as a gloss level of 100% when an incident angle is 60° on the surface of a glass whose refraction index is 1.567, or a reflectance of 5% is defined as a gloss level of 100% when an incident angle is 20° on the surface of the glass.

In the molded article of the invention, it is preferable that the gloss level is 150 or more, more preferably 160 or more, when an incident angle is 60°. The gloss level may be measured using a publicly-known gloss meter.

The molded article of the invention has a silver-white color tone and exhibits uniform color without color spot, and has excellent appearance and sheen. The color tone of the molded article and the color spot may be observed with eyes.

The molded article of the invention may be dyed. It is preferable that the dyeing may be performed rapidly after the alumite treatment not to deteriorate the activity of the oxide film. Specifically, the dyeing may be performed in such a manner that a pigment is filled into the micro-hole by adsorbing a dye or metal salt to the micro-hole on the surface of the oxide film and an inlet of the micro-hole is closed through a sealing process. Such a dyeing process is not specifically limited. Examples of the dyeing process include an alumite dyeing process of adsorbing a dye into an oxide film or an electrolytic coloring process of adsorbing a metal salt.

Even though the aluminum alloy is not dyed, the aluminum alloy may have a color tone different from an aluminum material through the alumite treatment, depending on the combination of a difference in a composition of the aluminum alloy and an electrolyte used in the alumite treatment (integral coloring). The oxide film is colored by the combination of a difference in the composition of the aluminum alloy and an electrolyte used in the alumite treatment, and this color exhibits good weatherability. When this integral coloring is used, the aluminum alloy may be sealed without a dyeing process after the alumite treatment.

The molded article of the invention has excellent sheen even if it is colored through these dyeing processes, thus making it possible to realize various decorations making good use of the aluminum alloy's own characteristics.

Since the molded article of the invention is excellent in economic efficiency, productivity, weatherability, decorativeness and appearance, it is suitably applicable to various fields such as household electrical appliances, automobile parts, precision instrument parts, interior/exterior materials for construction, and housewares.

EXAMPLES

Hereinafter, the invention will be more fully described according to Examples and Comparative Examples, but the invention is not limited to the Examples mentioned below.

Examples 1 to 7 and Comparative Examples 1 to 3

Aluminum alloys of Examples 1 to 7 and Comparative Examples 1 to 3 having respective compositions listed in Table 1 below were melted through a melting process.

Thereafter, each of the aluminum alloys was die cast using a cold chamber type die casting machine (mold clamping force: 250 ton) at a temperature ranging from 700 to 750° C., thereby obtaining die-cast moldings 1 to 10.

A dimension of the mold was 170×150×54 mm, and a material of the mold is SKD61.

The aluminum alloy of Comparative Example 1 is ADC12, the aluminum alloy of Comparative Example 2 is ADC6, and the aluminum alloy of Comparative Example 3 has a composition shown in Table 1 below.

TABLE 1

| Classification | Composition (wt. %) | | | | | | | |
|---|---|---|---|---|---|---|---|---|
| | Mn | Cr | Ti | Mg | Si | Fe | Cu | Al and impurities |
| Example 1 | 1.80 | 0.50 | 0.20 | 0.20 | 0.30 | 0.07 | — | Residue |
| Example 2 | 2.00 | 0.50 | 0.20 | 0.30 | 0.30 | 0.07 | — | Residue |
| Example 3 | 1.50 | 1.00 | 0.10 | 0.30 | 0.30 | 0.07 | — | Residue |
| Example 4 | 0.54 | 0.57 | 0.24 | 0.20 | — | — | — | Residue |
| Example 5 | 0.52 | 0.25 | 0.20 | 0.19 | — | — | — | Residue |
| Example 6 | 0.75 | 0.60 | 0.24 | 0.19 | 0.04 | 0.10 | — | Residue |
| Example 7 | 0.71 | 0.25 | 0.23 | 0.19 | — | — | — | Residue |

TABLE 1-continued

| Classification | Composition (wt. %) | | | | | | | |
|---|---|---|---|---|---|---|---|---|
| | Mn | Cr | Ti | Mg | Si | Fe | Cu | Al and impurities |
| Comparative Example 1 | 0.20 | — | — | 0.30 | 11.00 | 0.70 | 2.40 | Residue |
| Comparative Example 2 | 0.50 | — | — | 3.10 | 0.80 | 0.60 | — | Residue |
| Comparative Example 3 | 2.00 | — | — | — | — | 1.00 | — | Residue |

Next, to investigate the die-castability of the aluminum alloys of Examples 1 to 7 and Comparative Examples 1 to 3, a hot-tearing resistance, a filling property and an adhesion resistance to a mold were observed at the time of manufacturing the die-cast moldings 1 to 10.

The hot-tearing resistance, filling property and adhesion resistance were analyzed such that a very excellent case was symbolized as "⊙", a satisfactory case was symbolized as "o", an unsatisfactory case was symbolized as "Δ", and the worst case was symbolized as "x".

These analysis results are shown in Table 2 below.

Subsequently, specimens 1 to 10 each having a dimension of 80×54×4 mm and a thickness of 0.8 mm were prepared by partially cutting the die-cast moldings 1 to 10 respectively.

These specimens 1 to 10 were chemically polished for 2 minutes in a phosphoric acid-based treatment solution after being buffered, and then treated in a sulfuric acid solution at 22° C. for 20 minutes with a current density of 1 A/dm$^2$, thereby forming an oxide film with a thickness of about 7 μm. A sealing process was performed using an acetic acid nickel-based treatment solution for 10 minutes to thereby obtain molded articles 1 to 10 of Examples 1 to 7 and Comparative Examples 1 to 3.

Hardness of portions of the molded articles 1 to 10 on which the alumite treatment had not been performed was measured with a hardness tester (trade name: VK-M, manufactured by Matsusawa Precision Machining Co., Ltd.). The measurement results are shown in Table 2 below.

A gloss level, color tone and color uniformity (color spot) of the surface of each of the molded articles 1 to 10 were analyzed to estimate the appearance.

The gloss level was measured using a gloss meter (trade name: UNiGLOSS#60 (60°), manufactured by Minolta).

The color tone and color uniformity (color spot) were observed with naked eyes. The color uniformity was analyzed such that a very excellent case (there was no color spot and thus color was uniform) was symbolized as "⊙", a satisfactory case (there were a few color spots) was symbolized as "o", an unsatisfactory case (color spots were easily visible) was symbolized as "Δ", and the worst case (color spots were considerably noticeable) was symbolized as "x".

These analysis results for the gloss level, color tone and uniformity are shown in Table 2 below.

TABLE 2

| Classification | Die-castability | | | Hardness (HV) | Appearance of oxide film after alumite treatment | | |
|---|---|---|---|---|---|---|---|
| | Hot-tearing susceptibility | Filling property | Adhesion property | | Gloss level | Color tone | Color uniformity |
| Example 1 | ○ | ⊙ | ○ | 50 | 170 | Silver-white | ⊙ |
| Example 2 | ○ | ○ | ○ | 62 | 160 | Silver-white | ⊙ |
| Example 3 | ○ | ⊙ | ⊙ | 45 | 180 | Silver-white | ⊙ |
| Example 4 | ○ | ○ | ○ | 38 | 190 | Silver-white | ⊙ |
| Example 5 | ○ | ○ | ○ | 36 | 200 | Silver-white | ⊙ |
| Example 6 | ○ | ○ | ○ | 40 | 180 | Silver-white | ⊙ |
| Example 7 | ○ | ○ | ○ | 37 | 190 | Silver-white | ⊙ |
| Comparative Example 1 | ⊙ | ⊙ | ⊙ | 105 | 4.5 | Gray | X |
| Comparative Example 2 | ⊙ | ⊙ | Δ | 65 | 50 | Silver-gray | ○ |
| Comparative Example 3 | ○ | ○ | ○ | 45 | 60 | Silver-gray | Δ |

According to Table 2, it can be observed that the alloys of Examples 1 to 7 have excellent die-castability and high hardness, are excellent in gloss level, color tone and color uniformity, and have favorable appearances. Meanwhile, although the alloys of Comparative Examples 1 and 3 have good die-castability and the molded articles thereof have high hardness, the color tone, gloss level and color uniformity of the molded articles of Comparative Examples 1 and 3 are inferior to those of Examples 1 to 7.

The alloy of Comparative Example 2 shows an unsatisfactory adhesion resistance, and the molded article of Comparative Example 2 is low in gloss level and poor in appearance.

The invention claimed is:

1. An aluminum alloy for die casting, comprising: 0.5 to 2.5 wt. % of manganese, 0.2 to 1.0 wt. % of chromium, 0.1 to 0.5 wt. % of titanium , 0.1 to less than 0.5 wt. % of magnesium, and the remainder being aluminum and incidental impurities, wherein an alumite treatment is applied on a surface of the alloy, resulting in a silver-white color tone.

2. The aluminum alloy for die casting according to claim 1, wherein the content of a silicon is less than 0.5 wt %, the content of an iron is less than 0.5 wt. %, and the total content of silicon and iron in the aluminum alloy for die casting is less than 0.5 wt. %.

3. A molding obtained by die-casting the aluminum alloy for die casting according to claim 1.

4. The molding according to claim 3, wherein a surface hardness of the molding is 35 HV or more.

5. A molded article obtained by performing said alumite treatment on a surface of the molding according to claim 3.

6. A molded article obtained by performing said alumite treatment on a surface of a molding that is obtained by die-casting the aluminum alloy for die casting according to claim 1.

7. The molded article according to claim 5, wherein a gloss level is 160 or more.

8. The aluminum alloy for die casting according to claim 1, further comprising 0.04 to 0.3 wt. % of silicon.

9. The aluminum alloy for die casting according to claim 1, further comprising 0.07 to 0.1 wt. % of iron.

10. An aluminum alloy for die casting, consisting essentially of: 0.5 to 2.5 wt. % of manganese, 0.2 to 1.0 wt. % of chromium, 0.1 to 0.5 wt. % of titanium , 0.1 to less than 0.5 wt. % of magnesium, the remainder being aluminum and incidental impurities wherein an alumite treatment is applied on a surface of the alloy, resulting in a silver-white color tone.

11. The aluminum alloy for die casting according to claim 10, wherein the content of a silicon is less than 0.5 wt %, the content of an iron is less than 0.5 wt. %, and the total content of silicon and iron in the aluminum alloy for die casting is less than 0.5 wt. %.

12. An aluminum alloy for die casting, consisting essentially of: 0.5 to 2.5 wt. % of manganese, 0.2 to 1.0 wt. % of chromium, 0.1 to 0.5 wt. % of titanium , 0.1 to less than 0.5 wt. % of magnesium, 0.04 to 0.3 wt. % of silicon, 0.07 to 0.1 wt. % of iron and the remainder being aluminum and incidental impurities wherein an alumite treatment is applied on a surface of the alloy, resulting in a silver-white color tone.

* * * * *